US007007673B2

(12) United States Patent
Treusch

(10) Patent No.: US 7,007,673 B2
(45) Date of Patent: Mar. 7, 2006

(54) VEHICLE FUEL RAIL ASSEMBLY FOR FUEL DELIVERY AND LIQUID FUEL RETENTION

(75) Inventor: Christopher J. Treusch, St. Clair, MI (US)

(73) Assignee: Automotive Components Holdings, Inc., Dearborn, MI (US)

( * ) Notice: Subject to any disclaimer, the term of this patent is extended or adjusted under 35 U.S.C. 154(b) by 0 days.

(21) Appl. No.: 10/898,741

(22) Filed: Jul. 26, 2004

(65) Prior Publication Data

US 2006/0016433 A1 Jan. 26, 2006

(51) Int. Cl.
*F02M 37/04* (2006.01)

(52) U.S. Cl. ..... 123/456; 123/516

(58) Field of Classification Search ..... 123/516, 123/468, 469, 470, 456, 467
See application file for complete search history.

(56) References Cited

U.S. PATENT DOCUMENTS

| | | | | |
|---|---|---|---|---|
| 1,676,811 | A | | 9/1921 | Hise |
| 4,474,160 | A | | 10/1984 | Gartner |
| 4,519,368 | A | | 5/1985 | Hudson, Jr. |
| 4,554,902 | A | | 11/1985 | Atkins |
| 4,601,275 | A | * | 7/1986 | Weinand ..... 123/468 |
| 4,798,187 | A | | 1/1989 | Hudson, Jr. |
| 5,056,489 | A | * | 10/1991 | Lorraine ..... 123/468 |
| 5,090,385 | A | | 2/1992 | Usui et al. |
| 5,095,876 | A | * | 3/1992 | Yonekawa et al. ..... 123/468 |
| 5,197,435 | A | | 3/1993 | Mazur et al. |
| 5,253,628 | A | | 10/1993 | Brown |
| 5,277,166 | A | | 1/1994 | Freeland |
| 5,359,976 | A | * | 11/1994 | Nakashima et al. ..... 123/516 |
| 5,372,116 | A | | 12/1994 | Davis |
| 5,389,245 | A | | 2/1995 | Jaeger et al. |
| 5,535,724 | A | | 7/1996 | Davis |
| 5,577,478 | A | | 11/1996 | Tuckey |
| 5,806,500 | A | | 9/1998 | Fargo et al. |
| 5,865,160 | A | | 2/1999 | Kato |
| 5,943,994 | A | * | 8/1999 | Hosoi et al. ..... 123/468 |
| 6,135,092 | A | | 10/2000 | Schaenzer et al. |
| 6,216,672 | B1 | | 4/2001 | Mishima et al. |
| 6,216,675 | B1 | | 4/2001 | Bennett |
| 6,357,423 | B1 | | 3/2002 | Kanno |
| 6,422,207 | B1 | | 7/2002 | Kolb et al. |
| 6,601,564 | B1 | | 8/2003 | Davey |
| 6,615,801 | B1 | * | 9/2003 | Zdroik ..... 123/467 |
| 6,827,064 | B1 | * | 12/2004 | Akagi et al. ..... 123/431 |

* cited by examiner

*Primary Examiner*—Carl S. Miller

(57) ABSTRACT

A vehicle fuel rail system for fuel delivery and liquid fuel retainment therein. The vehicle fuel rail system comprises a fuel rail and a chassis connector in fluid communication with the fuel rail. The fuel rail has a first bank and a second bank connected to the first bank by way of a crossover line. The first bank has a first top portion and a first bottom portion and the second bank has a second top portion and a second bottom portion. The crossover line has a first end disposed at the first bottom portion and a second end disposed at the second top portion. The chassis connector has a tank end and an rail end wherein the tank end is connected to the vehicle fuel tank and the rail end is disposed at the first top portion.

22 Claims, 12 Drawing Sheets

VEHICLE FUEL RAIL ASSEMBLY FOR FUEL DELIVERY AND LIQUID FUEL RETENTION

BACKGROUND OF THE INVENTION

The present invention relates to a vehicle fuel rail assembly for an internal combustion engine having an improved fuel delivery system and an improved liquid fuel retention therein.

In warm climates, vehicle engine temperatures may exceed 200 degrees Fahrenheit or greater. At such high temperatures, fuel contained within the fuel rail system typically boils and evaporates. Elevated vapor pressure within the fuel rail system can provide the motive force to push fuel from the fuel rail to the chassis line back to the fuel tank. When a substantial portion of liquid fuel has been forced from the fuel rail system to the fuel tank, insufficient liquid fuel may be available to the injector cups to provide adequate fuel at start-up. As a result, such insufficient liquid fuel may cause the engine to require several seconds and/or multiple start up attempts to refill the fuel rail system sufficiently to start the engine.

Moreover, when fuel is delivered to a typical fuel rail system, the banks of the fuel rail are normally filled in series rather than in parallel. That is, the bank nearest in fluid communication with the fuel tank is typically filled first and then subsequent banks are filled. However, when a typical fuel rail is filled after a high temperature soak, engine problems may occur due to the uneven distribution of fuel within the fuel rail.

BRIEF SUMMARY OF THE INVENTION

The present invention generally provides an improved vehicle fuel rail system for fuel delivery from a fuel tank to fuel injector cups of a vehicle engine and for improved liquid fuel retention in the system. The fuel rail system is configured to provide an even distribution of fuel from the fuel tank to the injector cups of the vehicle engine. Moreover, the fuel rail system is configured to optimize liquid fuel retainment in the fuel rail system following a high temperature soak, such as at high temperatures when the engine is shut-off. The improved delivery of fuel to the fuel rail banks lessens the time and/or number of start attempts to refill the fuel rail sufficiently when the fuel rail system has an insufficient amount of liquid fuel therein.

In one embodiment of the present invention, the vehicle fuel rail system comprises a fuel rail and a chassis connector in fluid communication with the fuel rail. In this embodiment, the fuel rail has a first bank and a second bank in fluid communication with the first bank by way of a crossover line. The first bank has a first top portion and a first bottom portion adjacent and in fluid communication with the fuel injector cups. The second bank has a second top portion and a second bottom portion adjacent and in fluid communication with the fuel injector cups. The crossover line has a first end disposed at the first bottom portion and a second end. The second end is in fluid communication with the first end and is disposed at the second top portion for fuel inlet to the second bank.

In this embodiment, the chassis connector has a tank end and an rail end in fluid communication with the tank end. The tank end is connected to the fuel pump and the rail end is disposed at the first top portion of the first bank for fuel inlet to the first bank.

In another embodiment, the first bank includes a first inlet aperture through which the rail end of the chassis connector is disposed. Moreover, the first bank includes an outlet aperture through which the first end is disposed and the second bank includes a second inlet aperture through which the second end is disposed. In one aspect, the first inlet aperture is formed at the first top portion of the first bank. The inlet chassis line is disposed through the first inlet aperture and extends therefrom so that the rail end is disposed at the first top portion for fuel delivery to the first bank.

In another aspect, the outlet aperture is formed at the first bottom portion of the first bank. The crossover line is disposed through the outlet aperture and extends therethrough so that the first end is disposed at the first bottom portion.

In yet another aspect of the present invention, the second inlet aperture is formed at the second top portion of the second bank. The crossover line is disposed through the second inlet aperture and extends therethrough so that the second end is disposed at the second top portion.

Further objects, features and advantages of the invention will become apparent from consideration of the following description and the appended claims when taken in connection with the accompanying drawings.

DETAILED DESCRIPTION OF THE INVENTION

Figure 1:
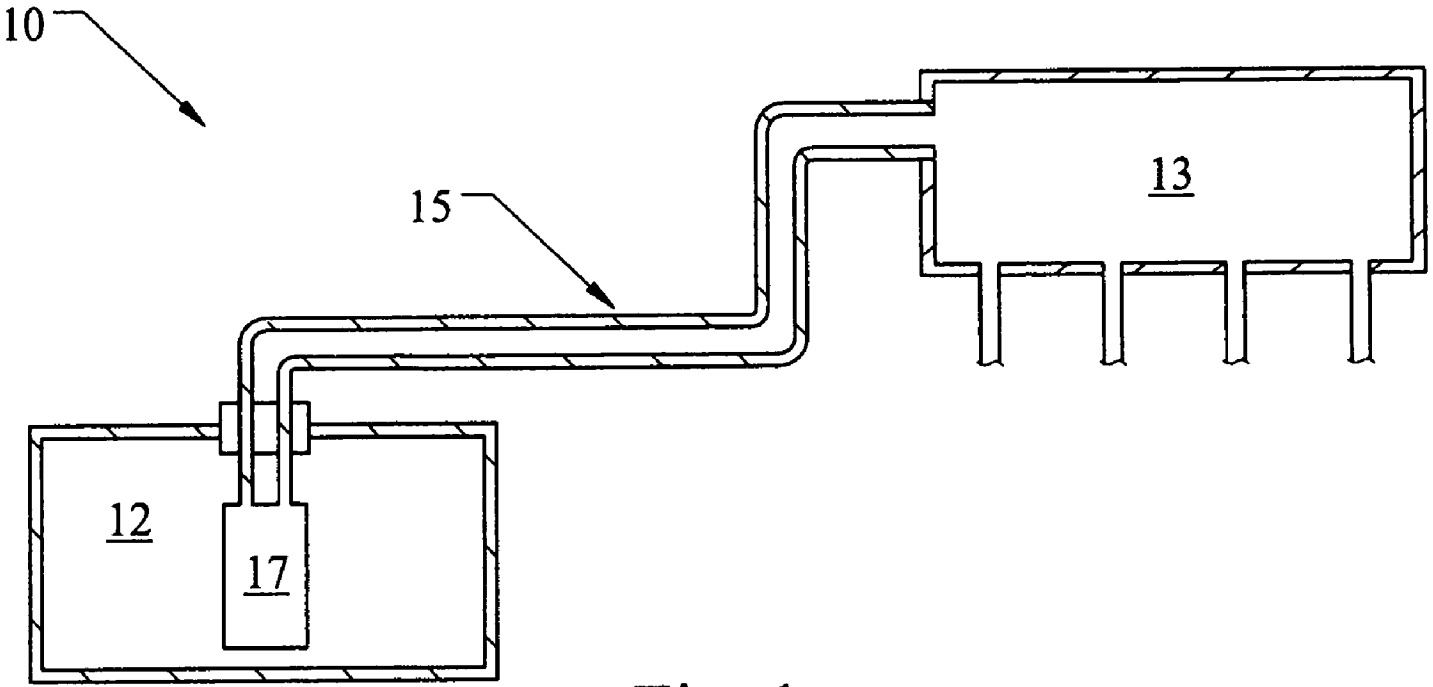
FIG. 1 is a schematic view of a vehicle having a fuel rail system in accordance with one embodiment of the present invention.

FIG. 1 generally illustrates a schematic view of a vehicle fuel delivery system 10 comprising a fuel tank 12, a fuel rail system 13 in fluid communication with fuel tank 12 by way of chassis connector 15. Fuel rail system 13 is configured to deliver fuel to fuel injector cups (not shown) of engine 18 by way of fuel pump 17. Generally, the present invention provides an improved fuel rail system for an even distribution of fuel to the engine and for improved retention of liquid fuel within the fuel rail system during a high temperature soak. As a result, engine start-ups from a high temperature soak take less time, and liquid fuel retention is maximized within the system.

Figure 2:
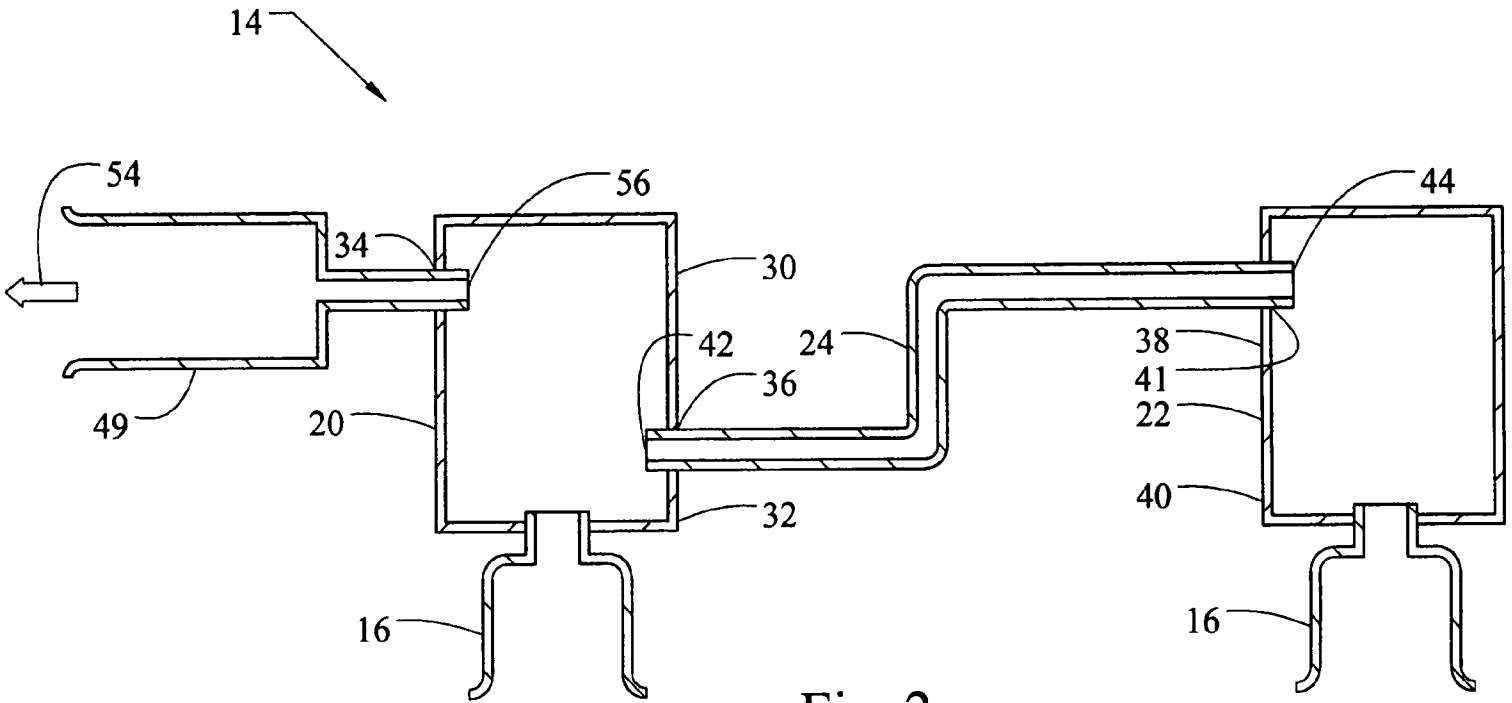
FIG. 2 is an end view of a fuel rail system in accordance with one embodiment of the present invention.

FIG. 2 illustrates a fuel rail system 14 in accordance with one embodiment of the present invention. As shown, fuel rail 14 includes a first bank 20 and a second bank 22 in fluid communication with the first bank 20 by way of a crossover line 24. As shown, the first bank 20 has a first top portion 30 and a first bottom portion 32 adjacent and in fluid communication with the fuel injector cups 16. Moreover, first bank 20 further includes a first inlet aperture 34 for fuel delivery to the first bank 20 formed at the first top portion 30. The first bank 20 further includes an outlet aperture 36 for fuel delivery therefrom and to the second bank 22. As shown, outlet aperture 36 is formed at the first bottom portion 32 of the first bank 20.

Second bank 22 includes a second top portion 38 and a second bottom portion 40 adjacent and in fluid communication with the fuel injector cups 16. In this embodiment, second bank 22 further includes a second inlet aperture 41 formed at the second top portion 38. As shown, the crossover line 24 has a first end 42 disposed at the first bottom portion and extends through the outlet aperture 36 to a second end 44 of the crossover line 24. In this embodiment, the second end 44 is in fluid communication with the first end 42 and is disposed through the second inlet aperture 41 to the second top portion 38 for fuel inlet to the second bank 22.

FIG. 2 further depicts an chassis connector 49 having a tank end 54 and an rail end 56 in fluid communication with the tank end. The tank end 54 is connected to the fuel tank and the rail end 56 is disposed through the first inlet aperture 34 at the first top portion 30 of the first bank 20 for fuel inlet to the first bank.

In this embodiment, the first inlet aperture 34 is formed at the first top portion 30 of the first bank 20. The chassis connector 49 is disposed through the first inlet aperture 34 and extends therefrom so that the rail end 56 is disposed at the first top portion for fuel delivery to the first bank. As shown, the outlet aperture 36 is formed at the first bottom portion 32 of the first bank 20. The crossover fuel line 24 is disposed through the outlet aperture 36 and extends therethrough so that the first end 42 is disposed at the first bottom portion 32. Moreover, the second inlet aperture 41 is formed at the second top portion 38 of the second bank 22. The crossover line 24 is disposed through the second inlet aperture 41 and extends therethrough so that the second end 44 is disposed at the second top portion 38.

It is to be understood that the first inlet aperture 34 may be formed at any location on the first bank 20 so long as the chassis connector 49 is disposed therethrough and extends to the rail end 56 at the first top portion of the first bank 20. Moreover, it is also to be understood that the outlet aperture 36 may be formed at any location on the first bank 20 so long as the crossover fuel line 24 extends to the first end 42 at the first bottom portion 32. Furthermore, it is to be understood that the second inlet aperture 41 may be formed at any location on the second bank 22 so long as the crossover fuel line 24 extends to the second end 44 at the second top portion 38 of the second bank 22.

Figure 3A:
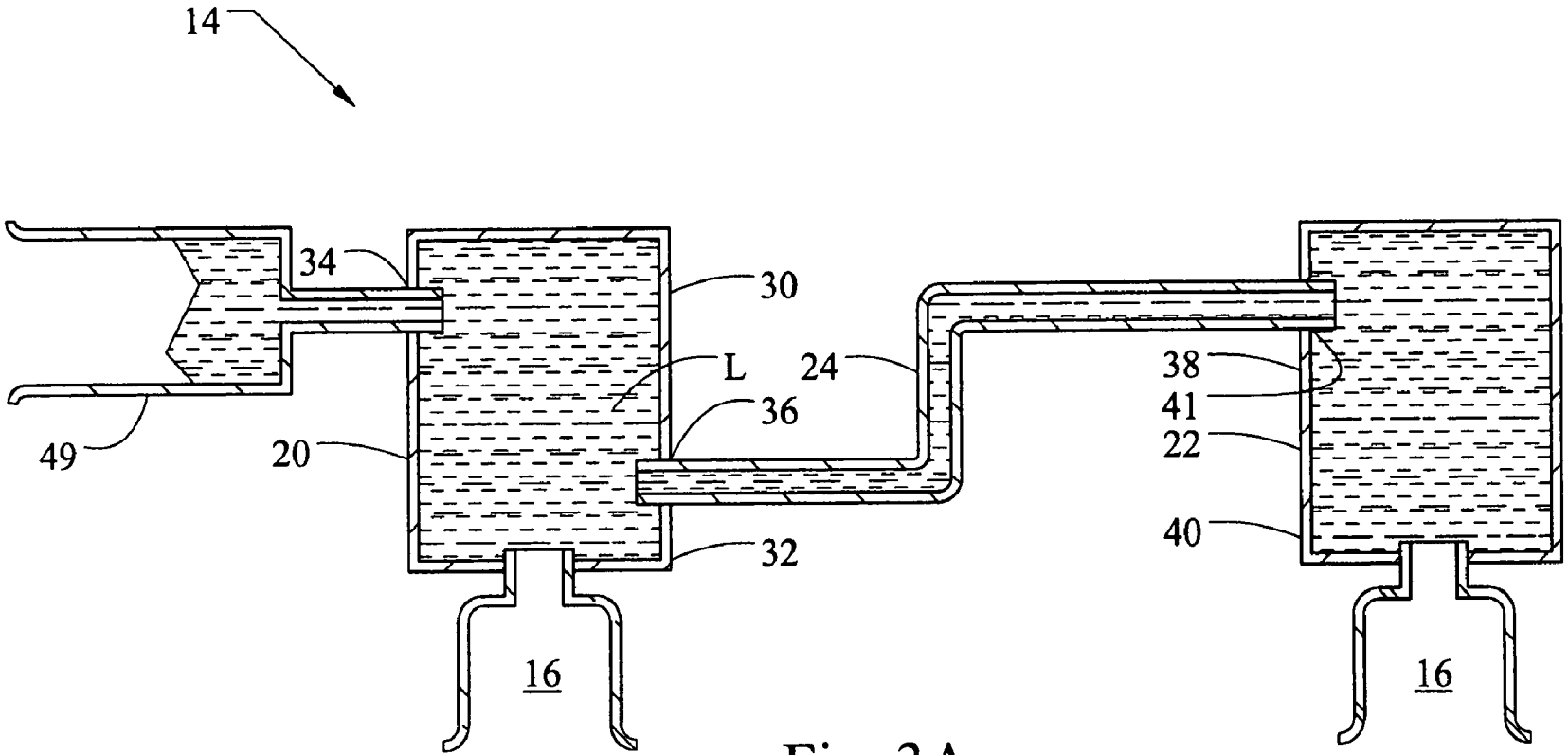
FIG. 3*a* is an end view of the fuel rail system in FIG. 2 before a high temperature soak.
Figure 3B:
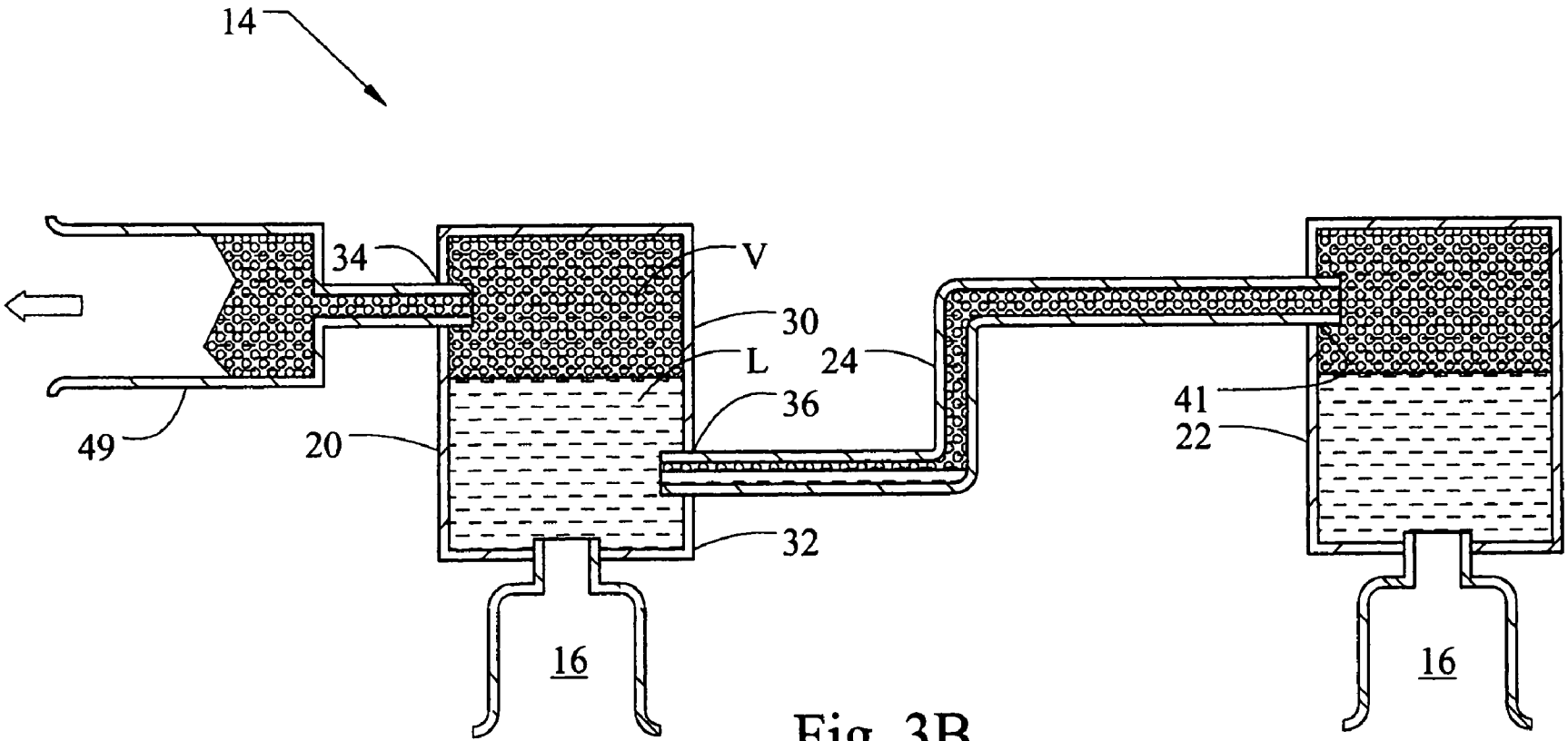
FIG. 3*b* is an end view of the fuel rail system in FIG. 3*a* during a high temperature soak.
Figure 3C:
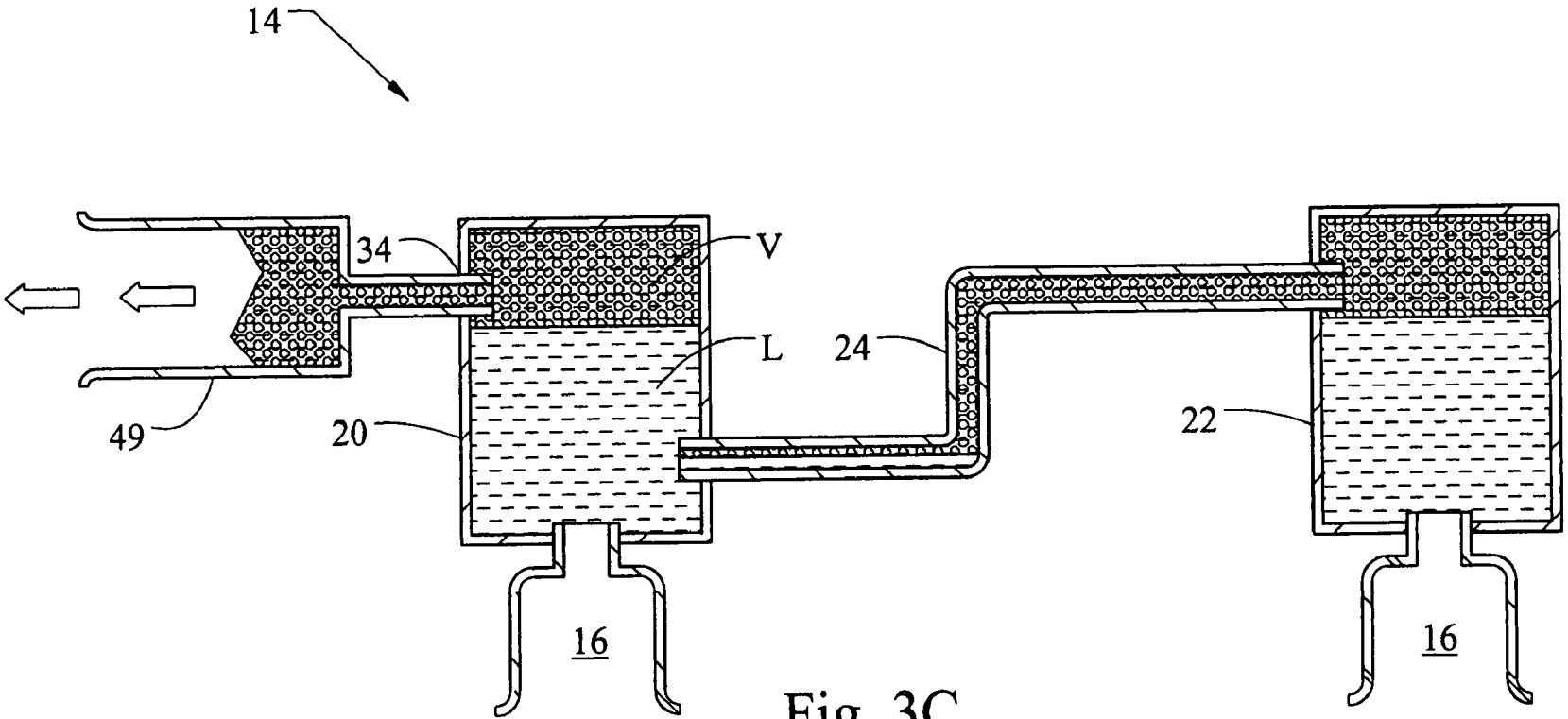
FIG. 3*c* is an end view of the fuel rail system in FIG. 3*a* during the high temperature soak.

FIGS. 3*a*–3*c* depict an example of the improved feature of liquid fuel retention in fuel rail system 14 during a high temperature soak. As shown in FIG. 3*a*, the fuel rail 14 initially is substantially filled with liquid fuel (L) in both first and second banks 20, 22. As temperature increases therein or system pressure decreases, vapor pressure of the fuel in the fuel rail 14 exceeds the system pressure. When the vapor pressure of the fuel exceeds the system pressure, liquid fuel begins to boil and vapor (V) forms at the top of the fuel rail as shown in FIG. 3*b*. FIGS. 3*b* and 3*c* illustrate the relatively high pressure in the fuel rail 14 resulting in a reverse flow of fuel out of the fuel rail and back toward the fuel tank.

The high position of the first inlet aperture 34 of the first bank 20 prevents most of the liquid fuel from being forced therefrom and to the fuel tank. The configuration of the first and second banks 20, 22, retains liquid fuel therein than otherwise would be retained. It has been found that the mass flow rate of liquid fuel (L) exiting the fuel rail 14 is substantially less than the mass flow rate of liquid fuel exiting a typical fuel rail configuration which is approximately 1000:1 liquid fuel mass flow rate to vaporized fuel mass flow rate. Thus, the fuel rail 14 is configured to retain liquid fuel long after a typical fuel rail is emptied of all or most of its liquid fuel.

Figure 4A:
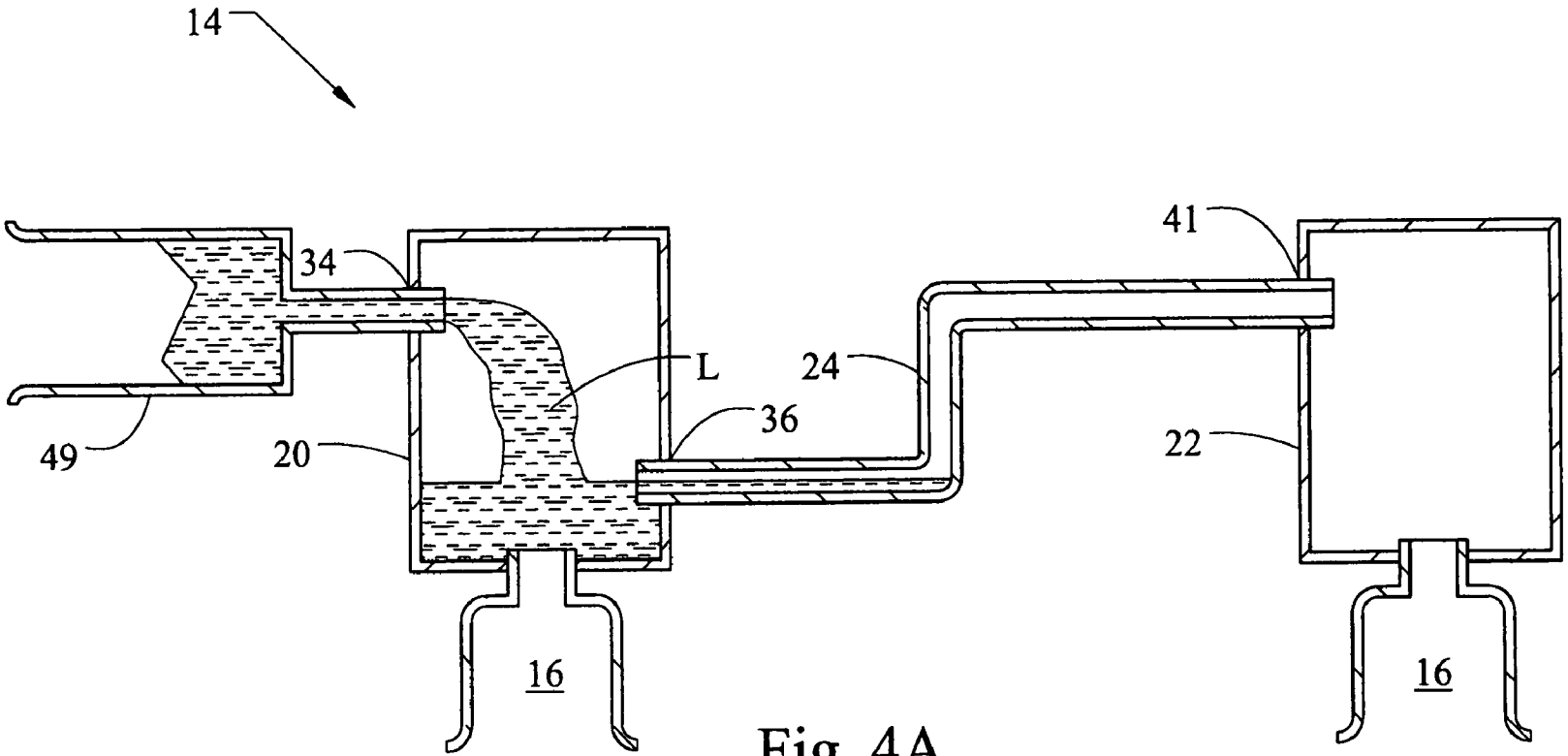
FIG. 4*a* is an end view of the fuel rail system of an engine in FIG. 2 at engine startup after liquid fuel has evaporated from the fuel rail.
Figure 4B:
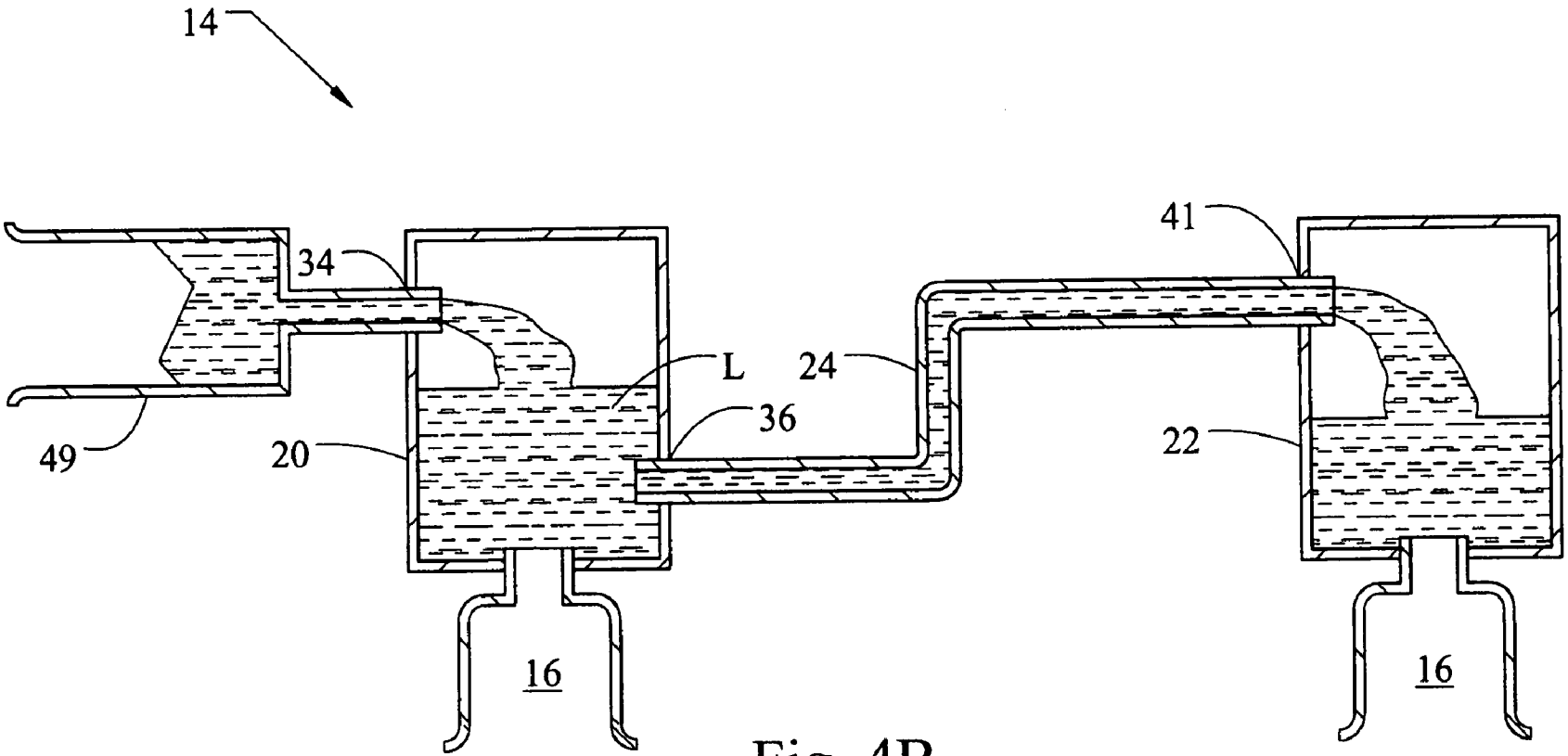
FIG. 4*b* is an end view of the fuel rail system in FIG. 4*a* during startup.
Figure 4C:
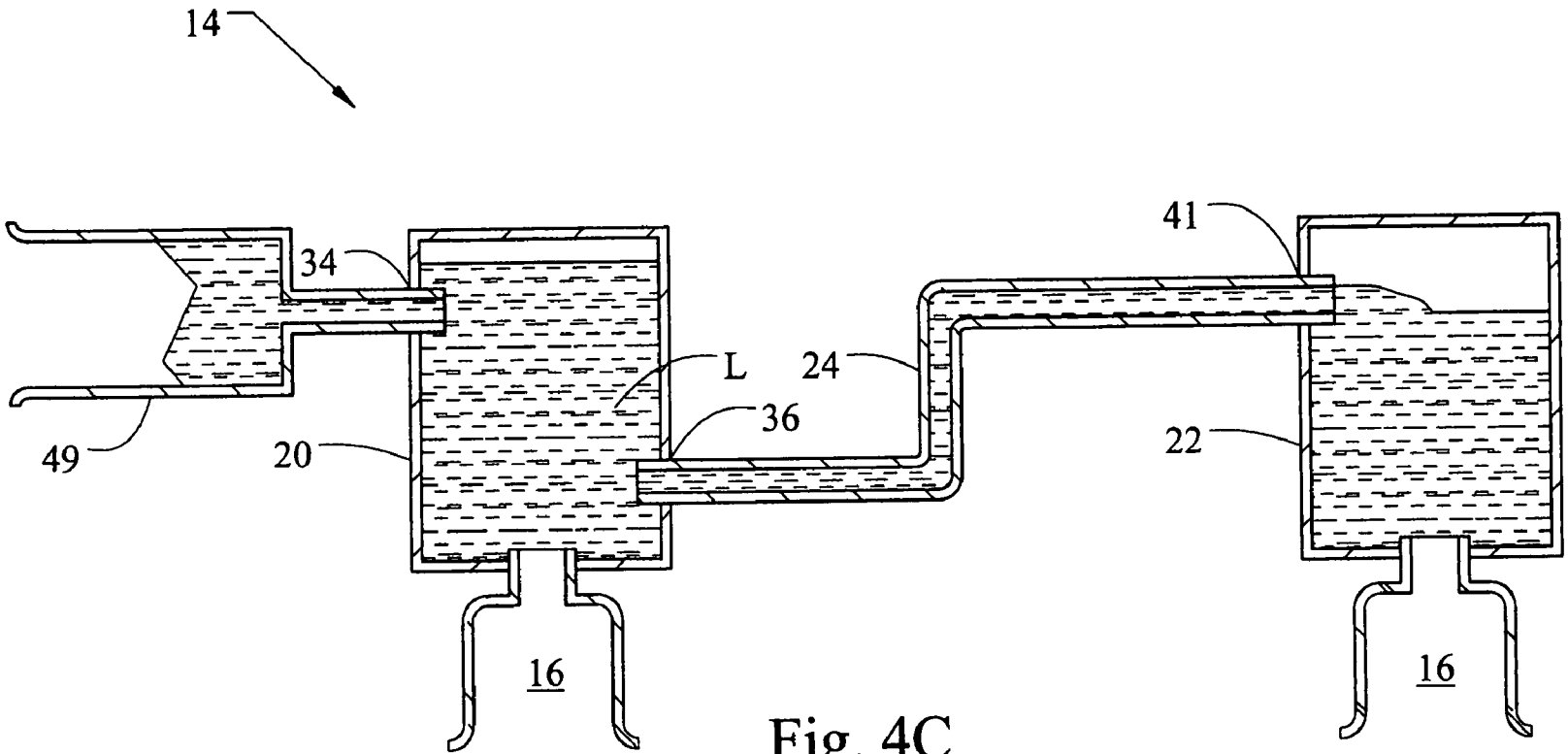
FIG. 4*c* is an end view of the fuel rail system in FIG. 4*a* during startup.

FIGS. 4*a*–4*c* depict fuel rail 14 being configured to optimize the refilling of first and second banks 20 and 22. This feature allows for effective hot starts, since liquid fuel (L) is available to both engine banks relatively evenly and relatively soon. The relatively low position of outlet aperture 36 of the first bank 20 allows liquid fuel to be fed to the second bank 22 relatively soon. In addition, less vapor fuel and more liquid fuel from the first bank 20 is forced to the second bank 22. Less compressed vapor in the second bank 22 results in a more efficient and more uniform filling of the first and second banks 20, 22.

Engine and engine compartment packaging constraints often dictate how a fuel rail system is configured or plumbed. For example, it is not always possible to form an inlet aperture of a bank at a top portion thereof and an outlet apertures at a bottom portion thereof. It is understood that aspects of the present invention include various configurations to comply with the packaging constraints while still minimizing the fuel vapor in the system. Each configuration of the present invention may comply with specific packaging constraints, yet each configuration may be functionally equivalent in terms of vapor management.

Preferably, inlet ends or connections are positioned at or near the top of the fuel rail bank and outlet ends or connections are positioned near the bottom of the fuel rail bank. In the direction of normal flow, the fuel should enter near the top of a rail bank and exit near the bottom of a rail bank. Preferably, the chassis connector connection feeds fuel to the top of the fuel rail and the crossover line connects to the bottom of the first bank and the top of the second bank.

Figure 5:
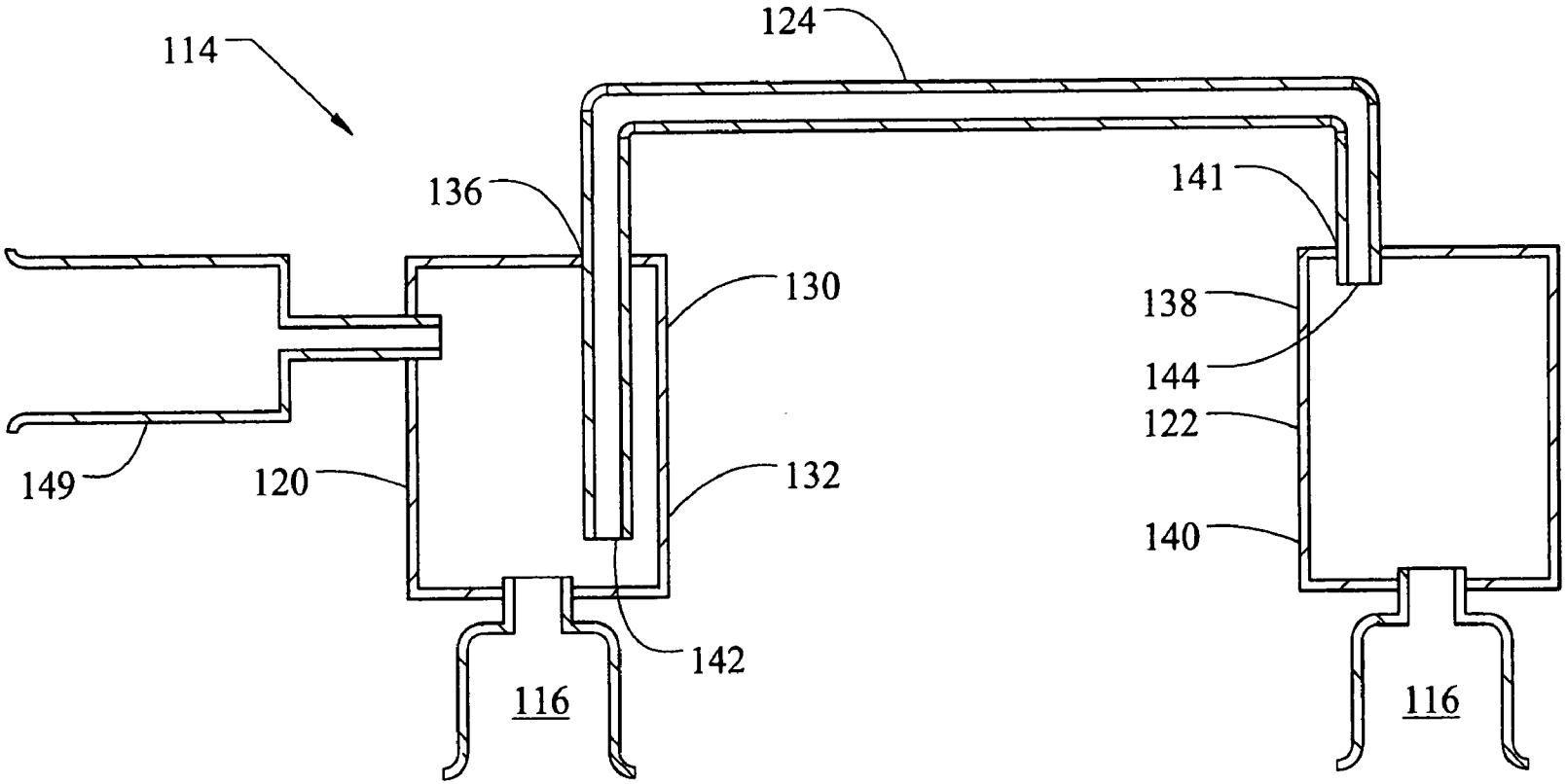
FIG. 5 is an end view of a fuel rail system in accordance with another embodiment of the present invention.

For example, FIG. 5 depicts a fuel rail system 114 in accordance with another embodiment of the present invention. Fuel rail system 114 includes components similar to fuel rail system 14 described above. For example, first bank 120, second bank 122, crossover line 124, and chassis connector 149 are similar to components first bank 20, second bank 22, crossover line 24, and chassis connector 49 of the embodiment described above. However, outlet aperture 136 in this embodiment is formed at a different location on the first bank 120 than outlet aperture 36 of the embodiment discussed above. In this embodiment, outlet aperture 136 is formed at the first top portion 130 of first bank 120. As shown, crossover line 124 is disposed through outlet aperture 136 and extends down to its first end 142 at first bottom portion 132.

Figure 6:
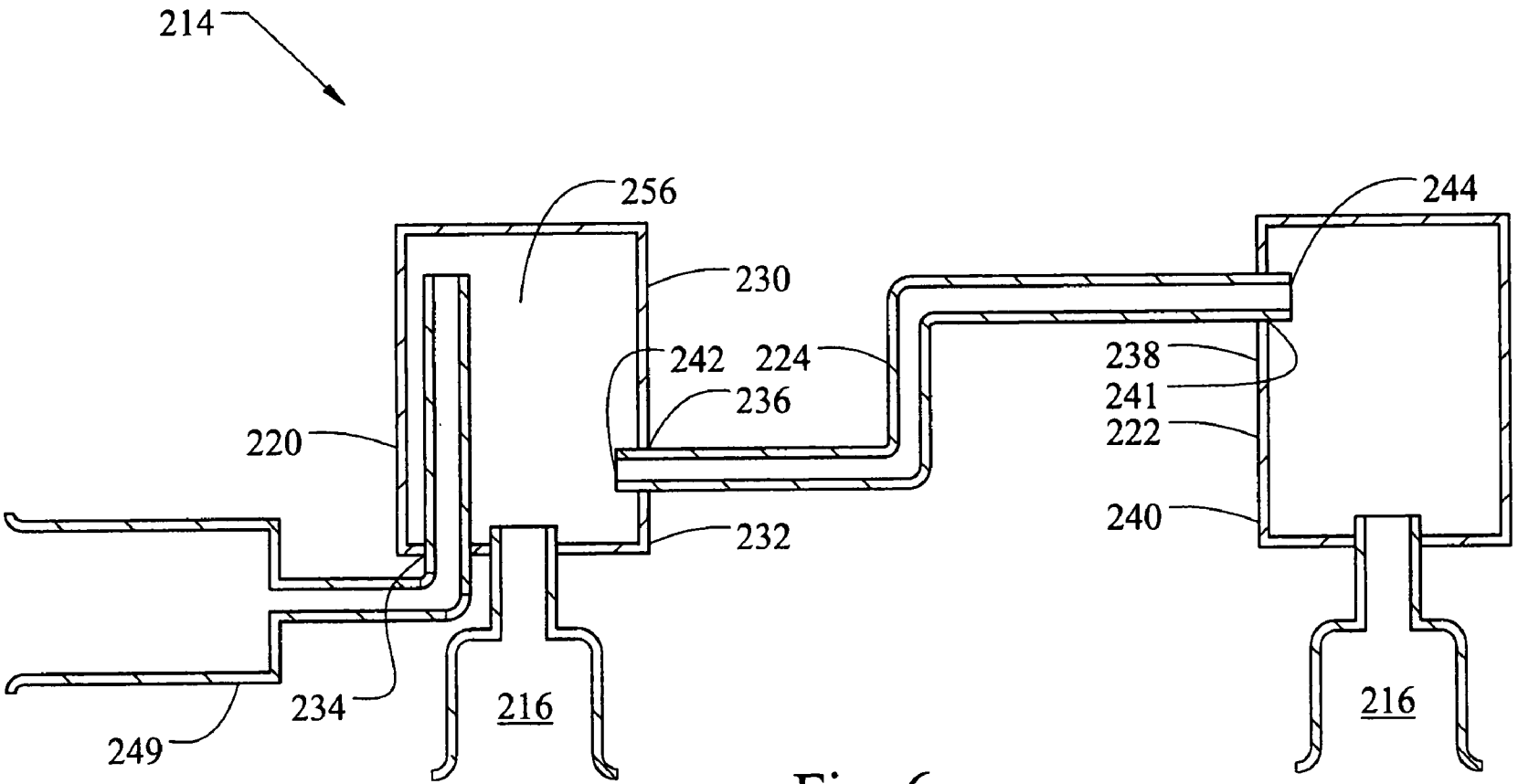
FIG. 6 is an end view of a fuel rail system in accordance with yet another embodiment.

FIG. 6 illustrates a fuel rail system 214 in accordance with another embodiment of the present invention. Fuel rail system 214 includes components similar to fuel rail system 14 described above. For example, first bank 220, second bank 222, crossover line 224, and chassis connector 249 are similar to components first bank 20, second bank 22, crossover line 24, and chassis connector 49 of the embodiment described above. However, inlet aperture 234 in this embodiment is formed at a different location on the first bank 220 than inlet aperture 34 of the embodiment discussed above. In this embodiment, inlet aperture 234 is formed at the first bottom portion 232 of first bank 220. As shown, chassis connector 249 is disposed through inlet aperture 234 and extends up to its rail end 256 at first top portion 230.

Figure 7:
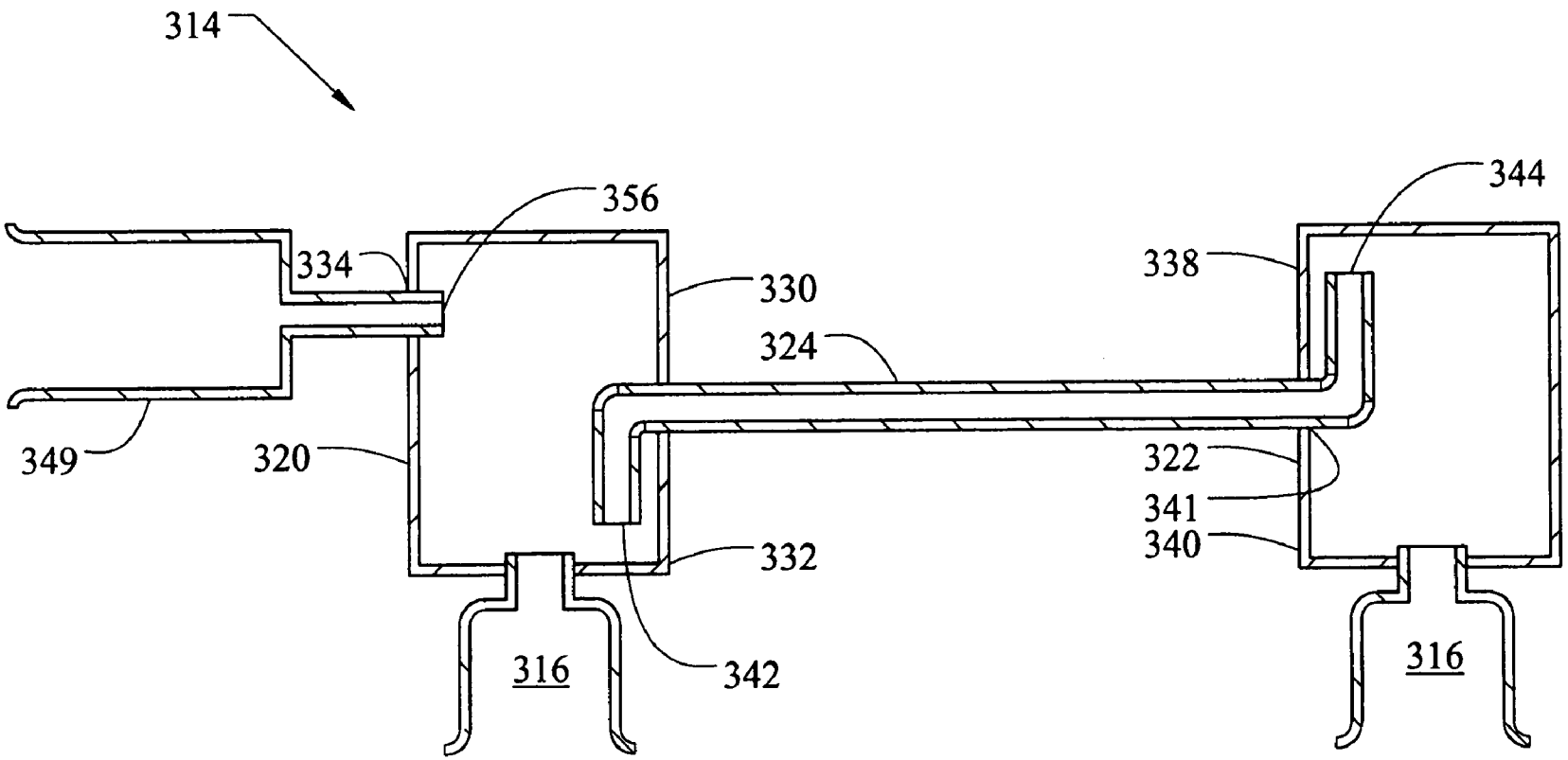
FIG. 7 is an end view of a fuel rail system in accordance with still another embodiment.

FIG. 7 depicts a fuel rail system 314 in accordance with another embodiment of the present invention. Fuel rail system 314 includes components similar to fuel rail system 14 described above. For example, first bank 320, second bank 322, crossover line 324, and chassis connector 349 are similar to components first bank 20, second bank 22, crossover line 24, and chassis connector 49 of the embodiment described above. However, outlet aperture 336 in this embodiment is formed at a different location on the first bank 320 than outlet aperture 36 of the embodiment discussed above. In this embodiment, outlet aperture 336 is formed between the first top portion 330 and the first bottom portion 332 of first bank 320. As shown, crossover line 324 is disposed through outlet aperture 336 and extends down to its first end 342 at first bottom portion 332.

Figure 8:
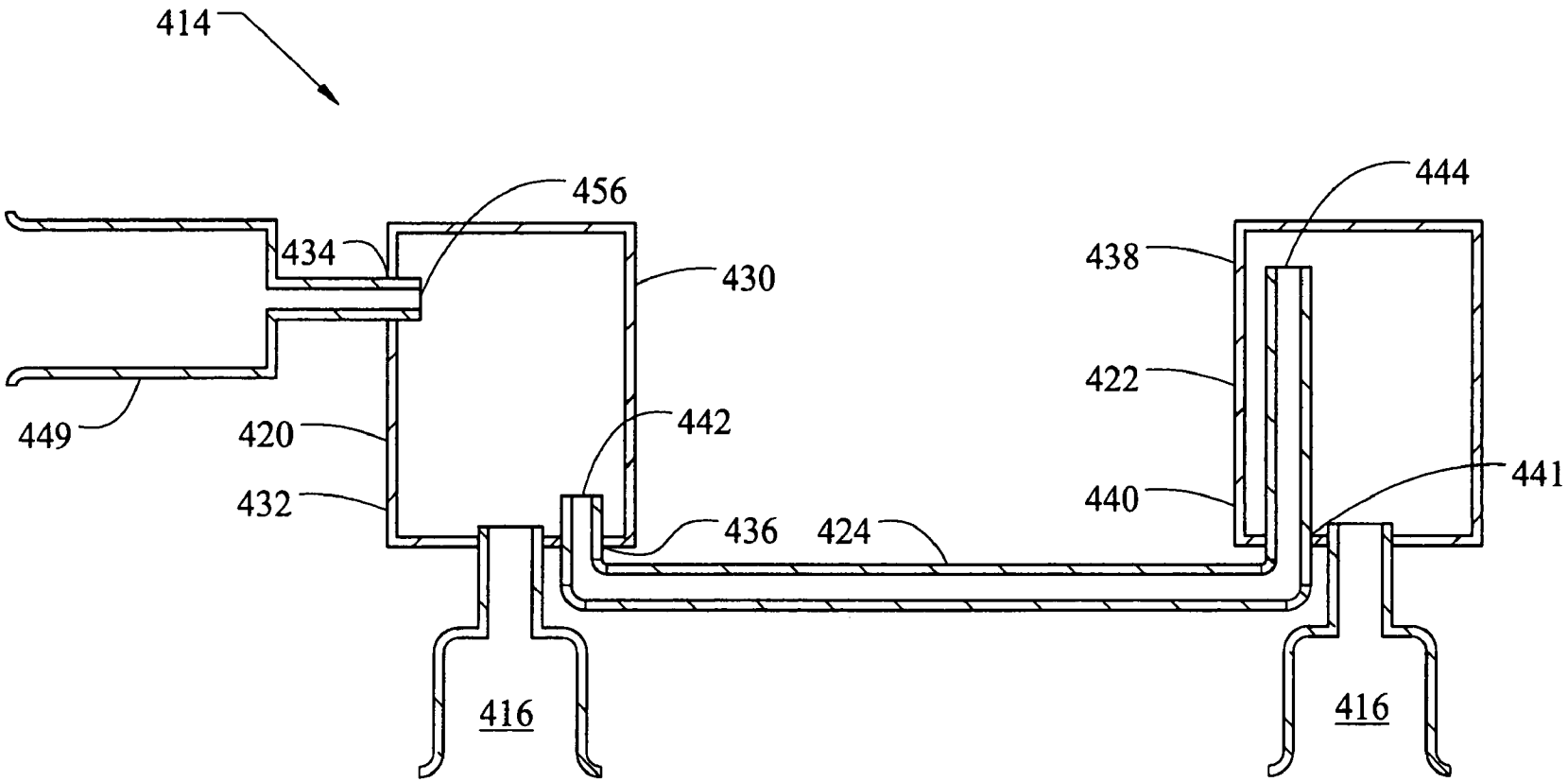
FIG. 8 is an end view of a fuel rail system in accordance with another embodiment.

FIG. 8 illustrates a fuel rail system 414 in accordance with another embodiment of the present invention. Fuel rail system 414 includes components similar to fuel rail system 14 described above. For example, first bank 420, second bank 422, crossover line 424, and chassis connector 449 are similar to components first bank 20, second bank 22, crossover line 24, and chassis connector 49 of the embodiment described above. However, second inlet aperture 441 in this embodiment is formed at a different location on the second bank 422 than second inlet aperture 41 of the embodiment discussed above. In this embodiment, second inlet aperture 441 is formed at the second bottom portion 440 of second bank 422. As shown, crossover line 424 is disposed through second inlet aperture 441 and extends to its second end 444 at second top portion 438.

While the present invention has been described in terms of preferred embodiments, it will be understood, of course, that the invention is not limited thereto since modifications may be made to those skilled in the art, particularly in light of the foregoing teachings.

The invention claimed is:

1. A vehicle fuel rail system for fuel delivery from a fuel tank to fuel injector cups of a vehicle engine and for improved liquid fuel retainment in the system, the system comprising:

a fuel rail having a first bank and a second bank in fluid communication with the first bank by way of a crossover line, the first bank having a first top portion and a first bottom portion adjacent and in fluid communication with the fuel injector cups, the second bank having a second top portion and a second bottom portion adjacent and in fluid communication with the fuel injector cups, the crossover line having a first end disposed at the first bottom portion and a second end, the second end being in fluid communication with the first end and disposed at the second top portion for fuel inlet to the second bank; and a chassis connector having a tank end and an rail end in fluid communication with the tank end, the tank end being connected to the fuel tank and the rail end being disposed at the first top portion of the first bank for fuel inlet to the first bank.

2. The system of claim 1 wherein the first bank includes a first inlet aperture through which the rail end of the chassis connector is disposed, wherein the first bank includes an outlet aperture through which the first end is disposed and wherein the second bank includes a second inlet aperture through which the second end is disposed.

3. The system of claim 2 wherein the first inlet aperture is formed at the first top portion of the first bank, the inlet chassis line being disposed through the first inlet aperture and extending therefrom so that the rail end is disposed at the first top portion for fuel delivery to the first bank.

4. The system of claim 2 wherein the first inlet aperture is formed at the first bottom portion of the first bank, the inlet chassis line being disposed through the first inlet aperture and extending therefrom so that the rail end is disposed at the first top portion for fuel delivery to the first bank.

5. The system of claim 2 wherein the outlet aperture is formed at the first bottom portion of the first bank, the crossover line being disposed through the outlet aperture and extending therethrough so that the first end is disposed at the first bottom portion.

6. The system of claim 2 wherein the outlet aperture is formed at the first top portion of the first bank, the crossover line being disposed through the outlet aperture and extending therethrough so that the first end is disposed at the first bottom portion.

7. The system of claim 2 wherein the outlet aperture is formed between the first top portion and the first bottom portion, the crossover line being disposed through the outlet aperture and extending therethrough so that the first end is disposed at the first bottom portion.

8. The system of claim 2 wherein the second inlet aperture is formed at the second top portion of the second bank, the crossover line being disposed through the second inlet aperture and extending therethrough so that the second end is disposed at the second top portion.

9. The system of claim 2 wherein the second inlet aperture is formed at the second bottom portion of the second bank, the crossover line being disposed through the second inlet aperture and extending therethrough to the second top portion so that the second end is disposed at the second top portion.

10. The system of claim 2 wherein the second inlet aperture is formed between the second top portion and the second bottom portion, the crossover line being disposed through the second inlet aperture and extending therethrough to the second top portion so that the second end is disposed at the second top portion.

11. The system of claim 1 further comprising a fuel pump for pumping fuel to the engine, the fuel pump being disposed between and in fluid communication with the engine by way of the inlet chassis line.

12. A vehicle fuel rail system for fuel delivery from a fuel tank to fuel injector cups of a vehicle engine and for improved liquid fuel retainment in the system, the system comprising:

a fuel rail having a first bank and a second bank in fluid communication with the first bank by way of a crossover line, the first bank having a first top portion and a first bottom portion being adjacent and in fluid communication with the fuel injector cups, the second bank having a second top portion and a second bottom portion adjacent and in fluid communication with the fuel injector cups, the crossover line having a first end disposed at the first bottom portion and a second end the second end being in fluid communication with the first end and disposed at the second top portion for fuel inlet to the second bank, the first bank including a first inlet aperture for fuel delivery to the first bank and an outlet aperture through which the first end is disposed, the second bank including a second inlet aperture through which the second end is disposed; and a chassis connector having a tank end and an rail end in fluid communication with the tank end, the tank end being connected to the fuel tank and the rail end being disposed through the first inlet aperture at the first top portion of the first bank for fuel inlet to the first bank.

13. The system of claim 12 wherein the first inlet aperture is formed at the first top portion of the first bank, the inlet chassis line being disposed through the first inlet aperture and extending therefrom so that the rail end is disposed at the first top portion for fuel delivery to the first bank.

14. The system of claim 12 wherein the first inlet aperture is formed at the first bottom portion of the first bank, the inlet chassis line being disposed through the first inlet aperture and extending therefrom so that the rail end is disposed at the first top portion for fuel delivery to the first bank.

15. The system of claim 12 wherein the outlet aperture is formed at the first bottom portion of the first bank, the crossover line being disposed through the outlet aperture and extending therethrough so that the first end is disposed at the first bottom portion.

16. The system of claim 12 wherein the outlet aperture is formed at the first top portion of the first bank, the crossover line being disposed through the outlet aperture and extending therethrough so that the first end is disposed at the first bottom portion.

17. The system of claim 12 wherein the outlet aperture is formed between the first top portion and the first bottom portion, the crossover line being disposed through the outlet aperture and extending therethrough so that the first end is disposed at the first bottom portion.

18. The system of claim 12 wherein the second inlet aperture is formed at the second top portion of the second bank, the crossover line being disposed through the second inlet aperture and extending therethrough so that the second end is disposed at the second top portion.

19. The system of claim 12 wherein the second inlet aperture is formed at the second bottom portion of the second bank, the crossover line being disposed through the second inlet aperture and extending therethrough to the second top portion so that the second end is disposed at the second top portion.

20. The system of claim 12 wherein the second inlet aperture is formed between the second top portion and the second bottom portion, the crossover line being disposed through the second inlet aperture and extending therethrough to the second top portion so that the second end is disposed at the second top portion.

21. The system of claim 12 further comprising a fuel pump for pumping fuel to the engine, the fuel pump being disposed between and in fluid communication with the engine by way of the inlet chassis line.

22. A vehicle fuel rail system for fuel delivery from a fuel tank to fuel injector cups of a vehicle engine and for improved liquid fuel retainment in the system, the system comprising:

a fuel rail having a first bank and a second bank in fluid communication with the first bank by way of a crossover line, the first bank having a first top portion and a first bottom portion being adjacent and in fluid communication with the fuel injector cups, the second bank having a second top portion and a second bottom portion adjacent and in fluid communication with the fuel injector cups, the crossover line having a first end disposed at the first bottom portion and a second end, the second end being in fluid communication with the first end and disposed at the second top portion for fuel inlet to the second bank, the first bank including a first inlet aperture for fuel delivery to the first bank and an outlet aperture through which the first end is disposed, the second bank including a second inlet aperture through which the second end is disposed; and a chassis connector having a tank end and an rail end in fluid communication with the tank end, the tank end being connected to the fuel tank and the rail end being disposed through the first inlet aperture at the first top portion of the first bank for fuel inlet to the first bank, wherein the first inlet aperture is formed at the first top portion of the first bank, the inlet chassis line being disposed through the first inlet aperture and extending therefrom so that the rail end is disposed at the first top portion for fuel delivery to the first bank, wherein the outlet aperture is formed at the first bottom portion of the first bank, the crossover line being disposed through the outlet aperture ard extending therethrough so that the first end is disposed at the first bottom portion, wherein the second inlet aperture is formed at the second top portion of the second bank, the crossover line being disposed through the second inlet aperture and extending therethrough so that the second end is disposed at the second top portion.

* * * * *